United States Patent [19]

Hargrave, Jr.

[11] 3,947,925

[45] Apr. 6, 1976

[54] BILLFOLD PROTECTION DEVICE

[76] Inventor: Fred M. Hargrave, Jr., J-21 Villa Caparra, Bayamon, P.R. 00619

[22] Filed: June 20, 1975

[21] Appl. No.: 588,835

[52] U.S. Cl. ..... 24/3 H; 150/47

[51] Int. Cl.[2] ..... A45C 13/18; A44B 24/00

[58] Field of Search.. 150/47; 24/3 H, 84 H, 49 CC, 24/73 B, 155

[56] References Cited

UNITED STATES PATENTS

| | | | |
|---|---|---|---|
| 2,285,670 | 6/1942 | Logsdon | 24/3 |
| 2,693,164 | 11/1947 | Bruchlos | 150/47 |
| 2,697,861 | 12/1954 | Shively | 24/3 |

*Primary Examiner*—Paul R. Gilliam
*Assistant Examiner*—Doris L. Troutman
*Attorney, Agent, or Firm*—Stevens, Davis, Miller & Mosher

[57] ABSTRACT

A billfold protection device for preventing the intentional or accidental unbuttoning of a pocket in which a billfold is contained is disclosed. The device is integral, made of resilient sheet material, and includes a first inverted U-shape vertically extending plate-like member which can be positioned in a pocket of a garment, such as a pair of pants, between the pocket material and the garment with the legs of the U-shaped member straddling the thread which connects the button to the garment. The device further includes a second substantially vertically extending plate-like member, the upper edge of which is connected to the upper edge of the first member. The second member is spaced from the first member so that the first and second members can straddle the upper edge of the pocket material adjacent the buttonhole therein so that the second member can cover the button and block access thereto. A flange is connected to and extends upwardly from the lower edge of the second member. The flange is positioned between the first and second members and can be positioned between the button and the pocket material to abut the lower portion of the button to thereby prevent the ready removal of the device from the pocket and thereby the intentional or accidental unbuttoning of the pocket. Furthermore, because the device is made of resilient sheet material, the flange is pivotable outwardly away from the button to clear the same to readily remove the device from the pocket and thereby permit unbuttoning of the pocket when the wearer of the garment desires access to the billfold.

10 Claims, 4 Drawing Figures

BILLFOLD PROTECTION DEVICE

BACKGROUND OF THE INVENTION

1. Field of the Invention

This invention relates to devices for preventing the unauthorized or accidental removal of a billfold from a pocket. More particularly, the invention relates to a billfold protection device for locking a billfold in a pocket on a garment in which the pocket material is buttoned by a button connected by thread to the garment and passed through a buttonhole in the pocket material.

2. Description of the Prior Art

Various devices have been proposed for preventing the ready removal of an object from a pocket.

U.S. Pat. No. 1,419,735 to A. B. Jardin discloses a closure for a garment pocket which includes a plate having a pair of extensions projecting therefrom. A portion of a section of material extends parallel with and is secured to the rear face of the plate. Another portion of the section of material is bent laterally away from the upper edge of the plate and extends downwardly therefrom to form a section which, by virtue of the resiliency of the section of material, tends to expand the opening of the pocket in which the closure is placed. As a result, an item in the pocket cannot be readily removed from the pocket because of the obstruction formed by the section of material. However, when it is desired to remove an item from the pocket, it is only necessary to insert a finger into the pocket in such a manner that the section of material is moved toward the plate.

U.S. Pat. No. 2,864,144 to E. B. Schick discloses a wallet protector which includes a main strip and a connecting strip which is used to hold the main strip and wallet in assembled relation. The main strip is longer than the width of the wallet so that the rounded end portions thereof project substantial distances laterally outwardly from the sides of the wallet. The main strip must be flexed into a pronounced arcuate shape whenever the wallet is to be removed from the pocket. This flexing of this main strip requires that one must insert his hand fully into the pocket and exert a positive force on the ends of the main strip in order to remove that wallet from the pocket.

U.S. Pat. No. 2,941,267 to R. F. Nelson discloses a wallet guard which includes a guard device placed within the confines of a pocket. The guard device is secured to the wallet and includes a hook support made of telescopic members, one of which is a tubular rod and the other of which is a slide rod telescopically fitted into the tubular rod. The tubular rod includes an inturned hook which is adapted to engage in an edge portion of the fold section of the wallet. The tubular rod is connected to an attachment plate by a pivotal connection which allows the hook support assembly to swing. The plate is detachably secured to a wall portion of the pocket and, once so secured in the pocket, the wallet can be attached to the guard device by applying the hooks of the tubular rod and slide rod to the opposite edge portions of the fold section of the wallet and securing the hooks in engaged position. In this position, the wallet is locked in the pocket and cannot be removed therefrom.

U.S. Pat. No. 3,144,894 to H. S. Young discloses a wallet guard which includes a magnet having two flexible metal prongs attached thereto which attach the magnet to the wallet. Alternatively, the prongs may be omitted and the magnet may be attached to the wallet by a few stitches of thread. The guard further includes a keeper made of spring steel which has two small holes drilled therethrough. Two safety pins pass through these holes and the bottom of the pocket to secure the keeper thereto. Alternatively, the keeper may be attached to the pocket by means of a few stitches of thread that pass through the holes in the bottom of the pocket. If a pickpocket grasps the top of the wallet and pulls it upward to extract it, the pull on the magnet is transmitted to the keeper and causes it to bend so that the middle portion thereof is drawn up. Further pulling up of the wallet causes the magnet to pull away from the keeper and the middle portion of the keeper to snap back against the bottom of the pocket to thereby warn the owner that the wallet is being stolen.

U.S. Pat. No. 3,422,498 to R. G. Carlson discloses a billfold safety guard which includes a chain, one end of which is connected to U-shaped member having two parallel legs which are separated by a space of sufficient width to permit a portion of a billfold to be inserted therein. The other end of the chain is secured to a means which includes a first and a second plate interconnected by a pin and a spring. One end of the spring bears against the second plate and the other end bears against an eye on one end of the pin. When the first plate is slipped through an eye formed in a portion of a garment, a spring forces the first and second plates to grip a pocket-defining portion of the garment therebetween. As a result, the billfold can be removed from the pocket a distance corresponding to the length of the chain but cannot be separated from the garment by reason of the attachment of the plates thereto.

SUMMARY OF THE INVENTION

This invention relates to a billfold protection device similar to those described above and is concerned with preventing the accidental or unauthorized removal of an item or billfold from a pocket.

The billfold protection device of this invention is for attachment to a pocket on a garment in which the pocket material is buttoned by a button and connected by threads or other means to the garment and passed through a buttonhole in the pocket material. The invention includes a substantially vertically extending inverted U-shaped member which is adapted to be positioned in the pocket between the pocket material and the garment with the legs of the U-shaped member straddling the thread or other means connecting the button to the garment. Advantageously, this member may be in the form of a thin plate-like member.

The invention also includes an upwardly extending flange which is adapted to be positioned between the button and the pocket material to abut the lower portion of the button whereby the abutment of the flange with the button prevents the ready removal of the device from the pocket and the unbuttoning of the pocket.

Between the flange and U-shaped member are means resiliently connecting the lower edge of the flange and the upper end of the member. As a result of this resilient connection, the flange can be pivoted outwardly away from the button to clear the same to readily remove the device from the pocket to permit unbuttoning of the pocket when desired.

Advantageously, the means resiliently connecting the lower edge of the flange and the upper end of the member comprises a substantially vertically extending member, the upper edge of which is resiliently connected to the upper edge of the first member. The second member is spaced from the first member so that the first and second members are adapted to straddle the upper edge of the pocket material adjacent the buttonhole therein so that the second member may cover the button and block access thereto. The flange may be connected to and may extend upwardly from the lower edge of the second member and be positioned between the first and second members.

The resilient connection between the flange and the U-shaped member is rendered possible because the billfold protection device may advantageously be made of a resilient sheet material, for example, resilient plastic sheet or sheet metal. This material must be self-supporting yet resilient enough to permit the flange to pivot away from the button to clear the same.

The device is preferably integral and includes a narrow band of inverted U-shaped cross-section interconnecting the upper edges of the first and second members as well as a narrow band of U-shapd cross-section interconnecting the lower edges of the flange and the second member. Also, the first member, the second member and the flange may be of substantially the same width, the length of the first member may be greater than that of the second member and the length of the second member may be at least twice that of the flange. Advantageously, the invention also includes an outer protective covering which is bonded or otherwise secured to the second member to cover the same.

From the foregoing, it is apparent that this ivention has as one of its principal objects, the provision of a billfold protection device which prevents the accidental, intentional, or unauthorized removal of a billfold or other item from a pocket in which it is secured.

A further object of this invention is to provide a billfold protection device which can be inexpensively manufactured and easily constructed.

A still further object of this invention is to provide a billfold protection device which is simple in construction and can be easily used.

DESCRIPTION OF THE PREFERRED EMBODIMENTS

Figure 2:
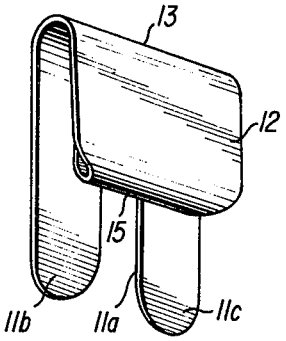
FIG. 2 is a perspective view of the billfold protection device.
Figure 3:
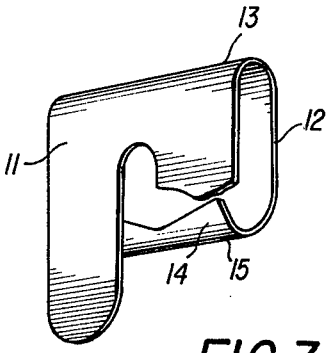
FIG. 3 is another perspective view of the billfold protection device with a portion broken away.
Figure 1:
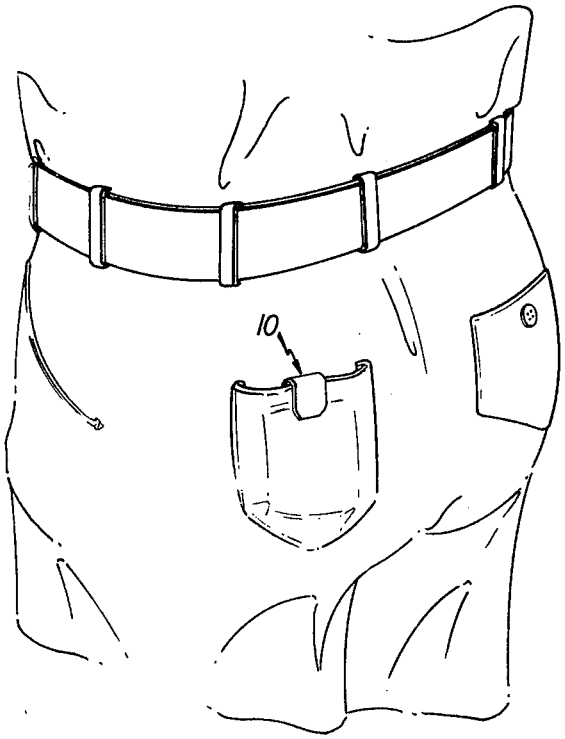
FIG. 1 is a perspective view showing the billfold protection device mounted over the pocket material of a pocket of a garment.
Figure 4:
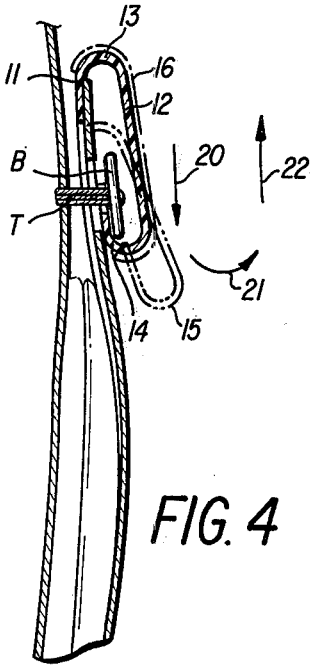
FIG. 4 is a cross-sectional view of the billfold device mounted over the pocket material for the pocket of a garment.

With reference to FIG. 1, there is shown therein an integral billfold protection device 10 mounted over the upper edge of the pocket material which together with the garment forms the pocket on a pair of pants. With reference to FIGS. 2 through 4, the billfold protection device 10 includes an inverted U-shaped substantially vertically extending plate-like member 11 and a second substantially vertically extending plate-like member 12 which extends parallel to the first member 11 but is outwardly spaced therefrom. The first member 11 and second member 12 are interconnected at their upper edges by a narrow band 13 of inverted U-shape cross-section. A flange 14 is connected to and extends upwardly from the lower edge of the second plate-like member 12. The flange 14 and the second plate-like member 12 are interconnected by a narrow band 15 of U-shaped cross-section at their lower edges.

The first plate-like member 11 has a vertical slot 11a defined therein. The slot **11*a* extends vertically upwardly from the lower edge of the plate 11 and divides a portion of the plate 11 into a pair of legs 11*a*, 11*c*. These legs are adapted to straddle the thread or other means T connecting the button to the garment when the plate-like member 11** is positioned in the pocket between the pocket material and the garment.

As noted above, the flange 14 is connected to and extends upwardly from the plate member 12 and is positioned between the plate members 11 and 12. As shown in FIG. 3, the upper edge of the flange 14 diverges outwardly from the center thereof toward the lateral edges so that the narrowest portion of the flange is positioned immediately adjacent the lowermost portion of the button when assembled over the pocket material.

The billfold protection device is preferably integral and made of a resilient sheet-like material, for example, plastic sheet or sheet metal. The particular material should be sufficiently rigid to render the device self-supporting and should also be sufficiently resilient to permit flexing or pivoting of the flange in a manner and for a reason to be subsequently described.

In use, the billfold protection device is placed over the upper edge of the material of the pocket with the legs **11*b*, 11*c* of the plate-like member 11 straddling the threads or other means T, as shown in FIG. 4, which secures the button B to the pants. Upon lowering of the billfold protection device 10 into the solid line position shown in FIG. 4, the flange 14 rides over the button B. When the billfold protection device is then moved upwardly a short distance, the flange 14 is positioned between the button B and the pocket material and abuts the lower portion of the button as shown in the solid line position of FIG. 4. As a result, the abutment of the flange 14** with the button B prevents the ready removal of the billfold protection device from the pocket and thereby also prevents the accidental, intentional or unauthorized unbuttoning of the pocket.

Because the resilience of the material of which the billfold protection device 10 is made, the flange 14 is pivotable relative to the other components of the device, particularly relative to the upper edge of plate-like member 11. In the preferred embodiment, the pivotable connection is thus formed by the resiliency of the narrow band 13 which interconnects the platelike members 11 and 12. When the garment wearer desires to remove his billfold from the pocket, he need merely push the billfold protection device 10 downwardly in the direction shown by the arrow 20 in FIG. 4 to the point where the flange 14 will clear the button B upon outward movement. The garment wearer may then exert a pulling force on the narrow band 15 so that the flange 14 pivots outwardly, as shown in the dotted line position in FIG. 4, to the point where it will clear the button B upon upward movement. At that point, the garment wearer need merely pull the billfold protection device upwardly in the direction of the arrow 22 in FIG. 4 so that the wallet protection device is then removed from the pocket. As a result, the garment owner then has access to the button B and can unbutton the same and remove the billfold from the pocket.

From the above, it is apparent that a pickpocket cannot readily remove the billfold from the pocket because to do so he would have to exert several different types of forces on the billfold protection device, which forces would alert the garment wearer to the fact that his billfold was being taken.

Furthermore, because the member 12 is substantially plate-like, it not only resiliently interconnects the flange 14 and the plate 11 but also functions to completely cover the button B and block access thereto.

When the billfold protection device 10 is made of a resilient yet hard plastic or sheet metal, it may be desirable to cover the outer portion of the plate-like member 12 and bands 13 and 15 with an outer protective covering 16, such as that shown in dotted lines in FIG. 4. This outer covering could be bonded or otherwise secured to the plate 12 and bands 13 and 15 and could be made of a relatively soft plastic, leather or other material. The outer covering functions to render the exposed portions of the billfold protection device relatively soft so that if the device comes into contact with any items such as furniture in which the wearer may sit, the wallet protection device will not scratch, cut or otherwise damage those items.

What I claim is:

1. A device for locking a billfold in a pocket on a garment in which the pocket material is buttoned by a button connected to the garment and passed through a buttonhole in the pocket material, said device comprising:

a substantially vertically extending inverted U-shape member adapted to be positioned in the pocket between the pocket material and the garment with the legs of the U-shape member straddling the connection of the button to the garment, an upwardly extending flange adapted to be positioned between the button and the pocket material and to abut the lower portion of the button, and means resiliently connecting the lower edge of said flange and the upper end of said member whereby the abutment of the flange with the button prevents the ready removal of the device from the pocket and the unbuttoning of the pocket and the resilient connection of the flange and the member renders the flange pivotable outwardly away from the button to clear the same to readily remove the device from the pocket to thereby permit unbuttoning of the pocket.

2. The device as claimed in claim 1 wherein:

said means comprises a substantially vertically extending plate-like member which is adapted to overlie the button and block access thereto.

3. A device for locking a billfold in a pocket on a garment in which the pocket material is buttoned by a button connected to the garment and passed through a buttonhole in the pocket material, said device comprising:

a first inverted U-shape substantially vertically extending plate-like member adapted to be positioned in the pocket between the pocket material and the garment with the legs of the U-shape member straddling the connection of the button to the garment, a second substantially vertically extending member, the upper edge of said second member being resiliently connected to the upper edge of the first member, said second member being spaced from said first member so that the first and second members are adapted to straddle the upper edge of the pocket material adjacent the buttonhole therein and said second member may cover the button, and a flange connected to and extending upwardly from the lower edge of the second member and positioned between the first and second members, said flange being adapted to be positioned between the button and the pocket material and to abut the lower portion of the button whereby the abutment of the flange with the button prevents the ready removal of the device from the pocket and thereby the unbuttoning of the pocket and the resilient connection of the first and second members renders the flange pivotable outwardly away from the button to clear the same to readily remove the device from the pocket to thereby permit unbuttoning of the pocket.

4. A device for locking a billfold in a pocket on a garment in which the pocket material is buttoned by a button connected to the garment and passed through a buttonhole in the pocket material, said device being integral, made of resilient sheet material, and comprising:

a first inverted U-shape substantially vertically extending plate-like member adapted to be positioned in the pocket between the pocket material and the garment with the legs of the U-shape member straddling the connection of the button to the garment, a second substantially vertically extending member, the upper edge of said second member being connected to the upper edge of the first member, said second member being spaced from said first member so that the first and second members are adapted to straddle the upper edge of the pocket material adjacent the buttonhole therein and said second member may cover the button and block access thereto, and a flange connected to and extending upwardly from the lower edge of the second member and positioned between the first and second members, said flange being adapted to be positioned between the button and the pocket material and to abut the lower portion of the button whereby the abutment of the flange with the button prevents the ready removal of the device from the pocket and thereby the unbuttoning of the pocket and the resilience of the sheet material renders the flange pivotable outwardly away from the button to clear the same to readily remove the device from the pocket to thereby permit unbuttoning of the pocket.

5. The device as claimed in claim 4, wherein:

a narrow band of inverted U-shape cross-section interconnects the upper edges of said first and second members, and a narrow band of U-shape cross-section interconnects the lower edges of the flange and the second member.

6. The device as claimed in claim 4, wherein:

an outer protective soft covering covers the second member.

7. The device as claimed in claim 5, wherein:

an outer protective covering covers the second member and both of said bands.

8. The device as claimed in claim 4, wherein:

the upper edge of the flange diverges outwardly from the center thereof toward the lateral edges so that the narrowest portion of the flange is adapted to be positioned immediately adjacent the lowermost portion of the button.

9. The device as claimed in claim 4, wherein:

the first member, the second member, and the flange have substantially the same width.

10. The device as claimed in claim 4, wherein:

the length of the first member is greater than that of the second member, and the length of the second member is at least twice that of the flange.

* * * * *